US005561857A

United States Patent [19]

Hoshizaki et al.

[11] Patent Number: 5,561,857

[45] Date of Patent: Oct. 8, 1996

[54] SHIN PAD WITH LATERAL SUPPORT

[75] Inventors: T. Blaine Hoshizaki, Montreal West; René Bourque; Rodrigue McDuff, both of Laval, all of Canada

[73] Assignee: Canstar Sports Group Inc., Quebec, Canada

[21] Appl. No.: 305,286

[22] Filed: Sep. 14, 1994

[30] Foreign Application Priority Data

Sep. 14, 1993 [CA] Canada ..... 2106159

[51] Int. Cl.[6] ..... A41D 13/06

[52] U.S. Cl. ..... 2/22

[58] Field of Search ..... 2/22, 2, 24, 62; 602/23, 26, 20

[56] References Cited

U.S. PATENT DOCUMENTS

| | | | |
|---|---|---|---|
| 844,041 | 2/1907 | Owens | 2/24 |
| 1,931,524 | 10/1933 | Becket | 2/22 |
| 4,751,748 | 6/1988 | Ekins | 2/24 X |
| 4,884,561 | 12/1989 | Letson, Sr. | 2/24 X |
| 4,999,847 | 3/1991 | Barcelo | 2/24 |

FOREIGN PATENT DOCUMENTS

| | | | |
|---|---|---|---|
| 2513002 | 10/1976 | Germany | 2/24 |
| 3905837 | 9/1989 | Germany | 2/24 |

*Primary Examiner*—Paul C. Lewis

[57] ABSTRACT

The shin pad, for use in ice hockey and possibly other sports, includes a lower brace element positionable along the front of the player's shin and securable to the player's lower leg, and an upper brace element positionable along the front of the player's lower thigh and securable thereto. A shin shield is secured outside the lower brace element. The lower and upper brace elements are pivotally connected to each other by pivotal connections on lateral and medial sides thereof, the pivotal connections being positionable on lateral and medial sides of the player's knee, in general alignment with the axis of the player's knee joint. To restrict or prevent hyperextension of the knee, the shin pad includes a stop arranged to prevent rotation of the upper and lower brace elements beyond a selected maximum permissible extension angle. To maintain protection when the knee is flexed, the upper and lower brace elements preferably include overlapping arcuate kneecap portions, one on each of the brace elements, arranged such that no gap between them when the knee is flexed. As the stop, the upper arcuate kneecap portion may come into contact with the shin shield when the maximum permissible extension angle is reached.

5 Claims, 4 Drawing Sheets

SHIN PAD WITH LATERAL SUPPORT

BACKGROUND OF THE INVENTION

This invention relates to shin pads for use as protective gear in ice hockey, and possibly other sports.

In ice hockey, shin protectors or pads conventionally have a flexible elongated lining of felt, foam or sewn cushioning material which may be arranged to wrap partially around the front of a players lower leg, from the ankle to just above the knee. Rigid or semi-rigid shin and knee shields, of polyethylene for example, are secured to the outside of the pad. The shin shield runs from the ankle to just below the knee, and the knee shield covers the knee. Separate shield members are used so that the pad can bend slightly to accommodate flexing of the knee.

Conventional shin pads, although sufficient to protect the knee against puck impact, offer little or no protection against injuries to the knee ligaments caused by heavy lateral impact or by hyperextension from heavy frontal impact, such as may occur in a body-check. Such knee injuries are all too common in hockey, however. There is therefore a need for a pad which will provide improved knee protection.

Preventing or restricting hyperextension is particularly desirable, in order to reduce the likelihood of injury to the anterior cruciate ligament, which connects the femur to the tibia, underneath the patella (knee cap). This ligament is quite short compared to the other major knee ligaments, i.e. the posterior, medial and lateral cruciate ligaments. This ligament is therefore unable to stretch very much, and is very vulnerable to severe injuries, e.g. severing, when the knee is hyperextended. These types of injuries are often career-ending, in many sports.

Injuries to the medial and lateral ligaments are more often of the strain or mild tear variety. It is quite rare to completely sever these ligaments. This is because both the medial and lateral cruciate ligaments are significantly longer than the anterior cruciate ligament, thereby providing greater ability to withstand stretching. However, these injuries can still be quite severe, and may require extensive rehabilitation and a lengthy recovery period.

Another characteristic of conventional shin pads is that when a player flexes his knee, the lower thigh area above the knee can become exposed, because the knee shield is basically attached to the shin shield, and therefore follows its movement. This is particularly a problem for players who drop to their knees to block a shot, since the puck may hit that exposed area, with potential for injury or at least considerable pain.

SUMMARY OF THE INVENTION

In view of the above, it is an object of the invention to provide a shin pad construction which provides improved protection against heavy lateral and frontal impacts, while also providing improved protection for the area above the knee.

It is not an object of the invention to provide the full degree of support and protection for a knee which a full knee brace can provide. It is merely an object of the invention to improve on the prior art by providing a certain degree of protection in that regard. It will be appreciated that the invention is not intended to nor guaranteed to fully prevent injury to the knee or to replace a knee brace. No pad can withstand all conceivable blows. The pad of the present invention can be expected to provide improved protection against knee injuries, but will not necessarily prevent all knee injuries.

Accordingly, in the invention, the shin pad includes a lower brace element positionable along the front of the player's shin and securable to the player's lower leg, and an upper brace element positionable along the front of the player's lower thigh and securable thereto. The lower and upper brace elements are pivotally connected to each other by pivotal connections on lateral and medial sides thereof, the pivotal connections being positionable on lateral and medial sides of the player's knee, in general alignment with the axis of the player's knee joint.

To restrict or prevent hyperextension of the knee, the shin pad includes stop means arranged to prevent rotation of the upper and lower brace elements beyond a selected maximum permissible extension angle.

To maintain protection when the knee is flexed, the upper and lower brace elements preferably include overlapping arcuate kneecap portions, one on each of the brace elements, arranged such that no gap between them when the knee is flexed.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
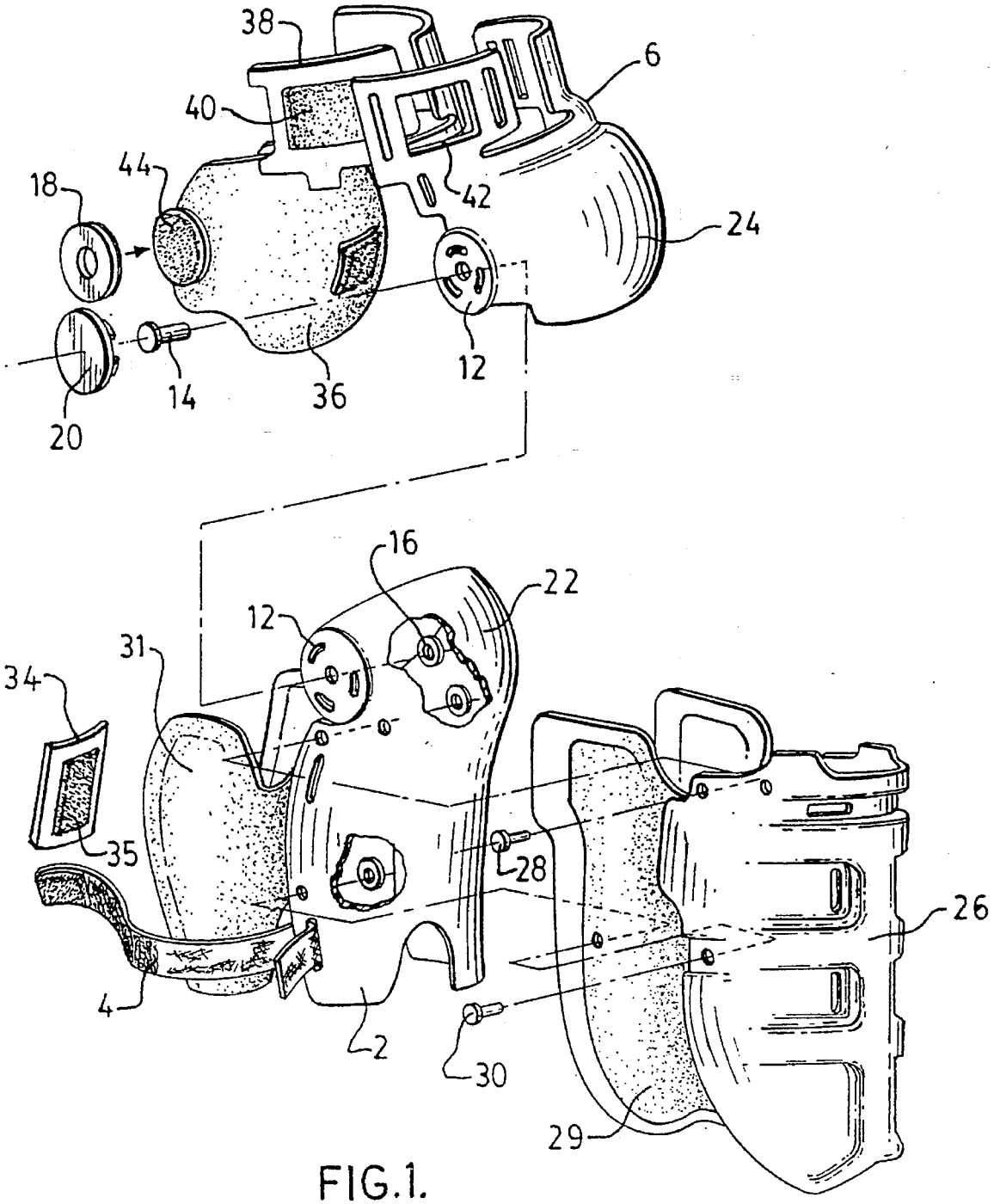
FIG. 1 is an exploded perspective of the preferred embodiment of the pad.
Figure 3:
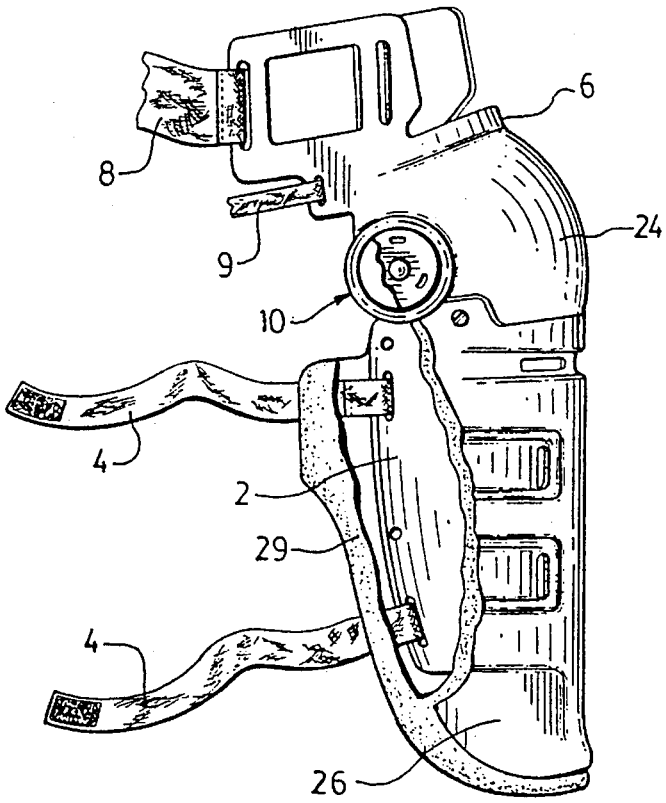
FIG. 3 is a side view of the pad, similar to FIG. 1, but cut open to show details.
Figure 2:
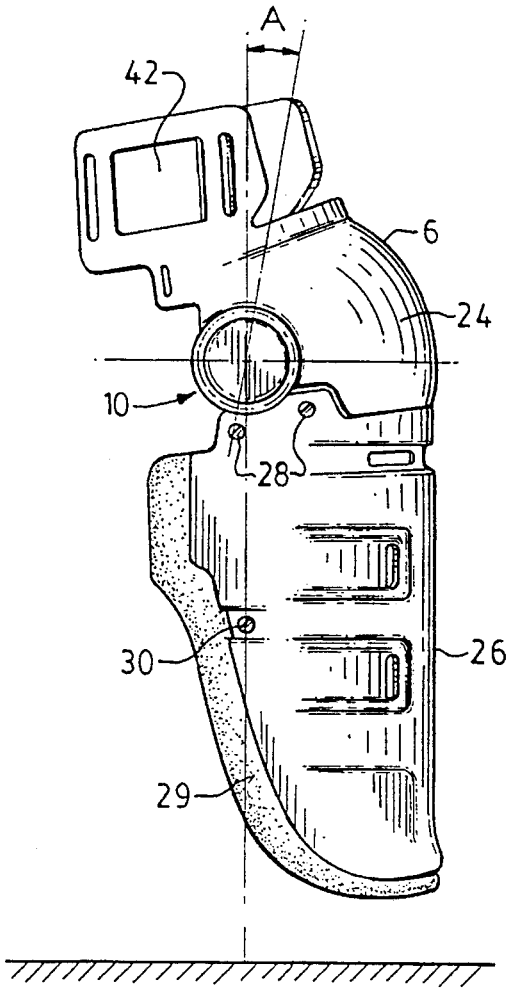
FIG. 2 is a side view of the pad.
Figure 4:
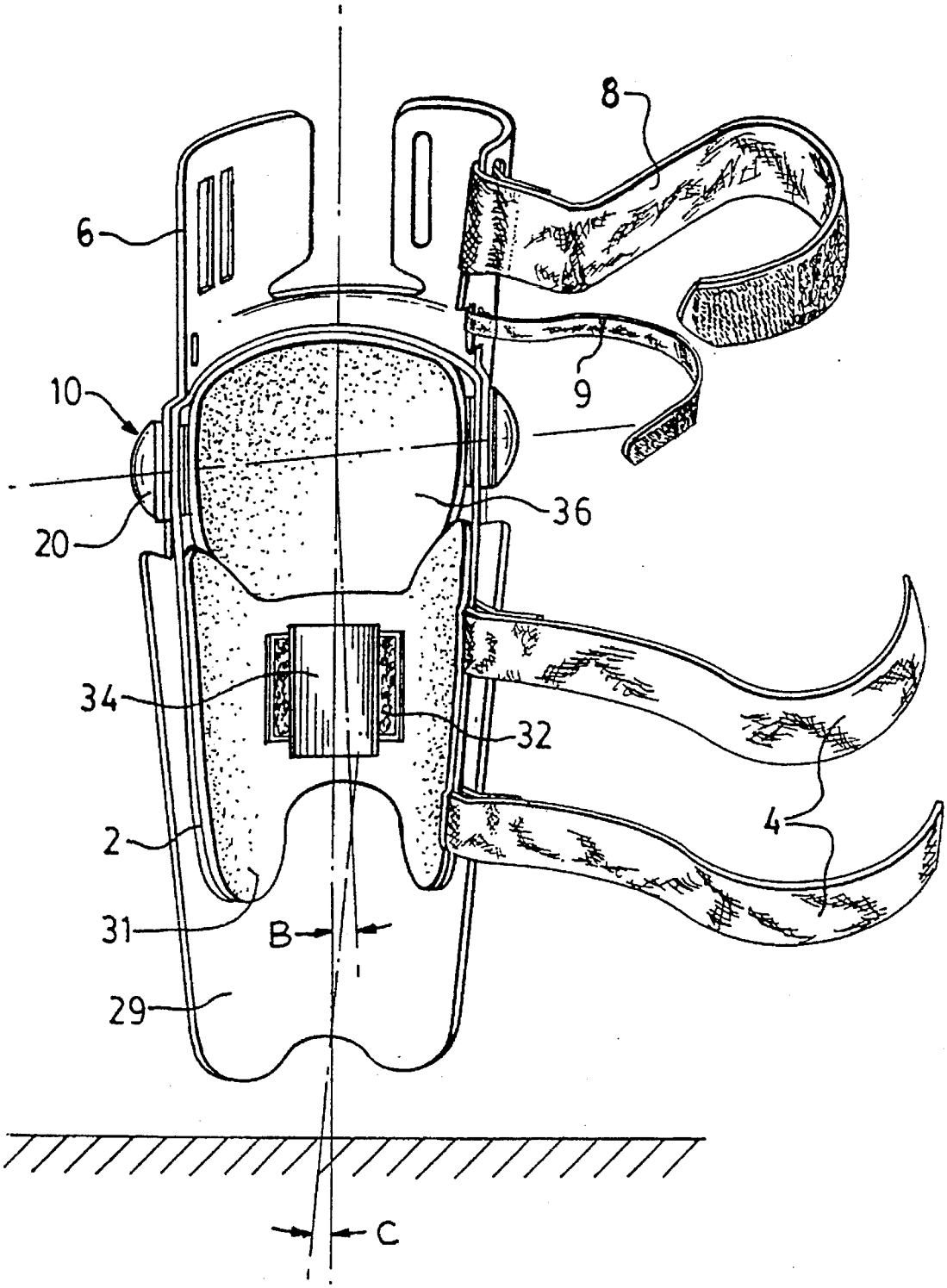
FIG. 4 is a rear view of the pad.
Figure 5:
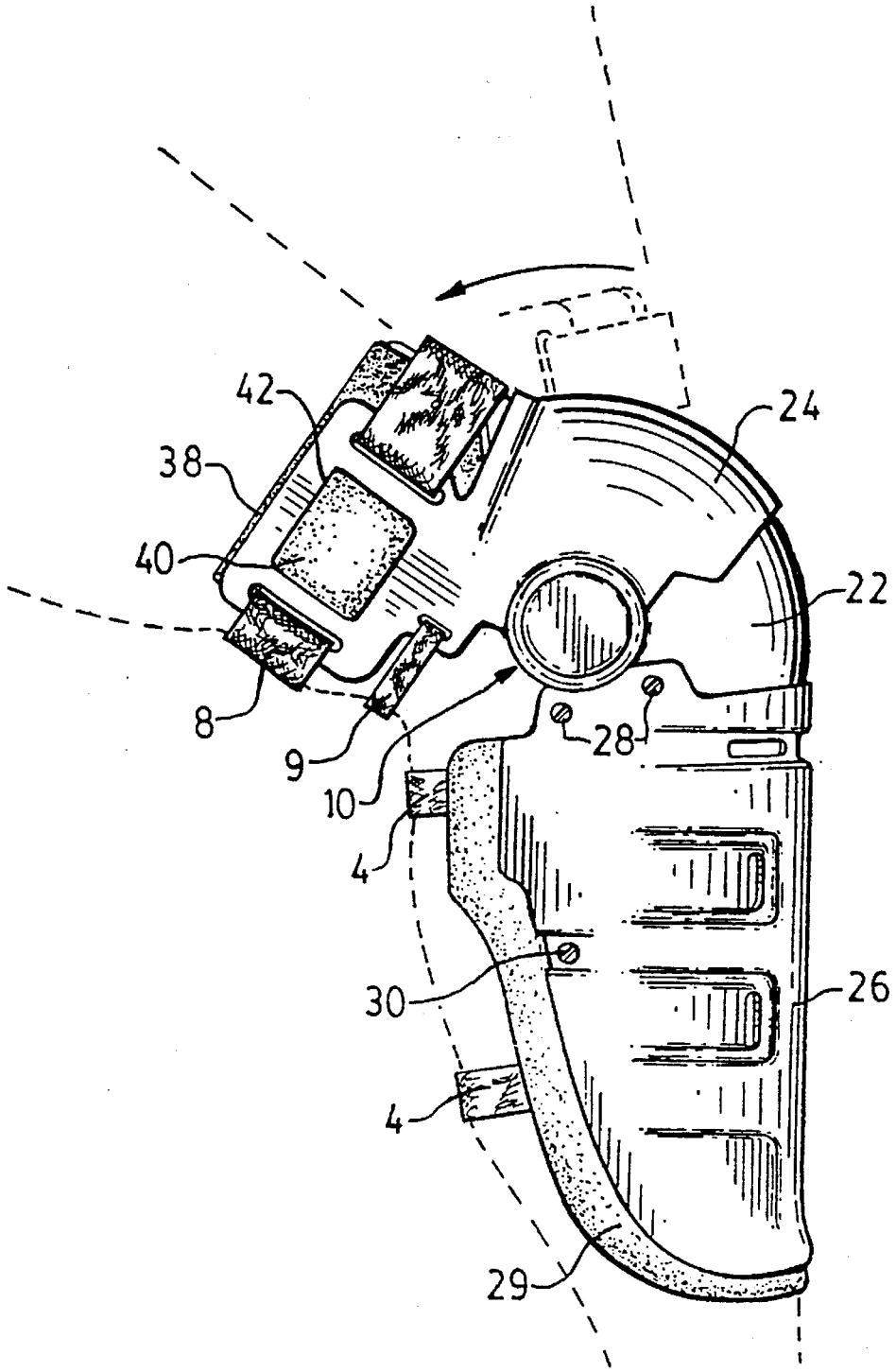
FIG. 5 is a side view of the pad, showing its operation when the knee is flexed.

Referring to the drawings generally, the shin pad includes a lower brace element 2 positionable along the front of the player's shin and securable to the player's lower leg via two straps 4 (only one being shown in FIG. 1), and an upper brace element 6 positionable along the front of the player's thigh and securable thereto via two straps 8 and 9 (not shown in FIG. 1, but visible in FIGS. 4 and 5). The lower and upper brace elements are pivotally connected to each other by pivotal connections 10 on lateral and medial sides thereof, the pivotal connections being positionable on lateral and medial sides of the player's knee, in general alignment with the axis of the player's knee joint. The pivotal connections each involve relatively flat disc-like portions 12 integral to the brace elements, with central holes through which a rivet 14 is installed. The rivet secures a washer 16, which in turn holds a larger washer 18, about which more will be said later. A cap 20 is positioned over the outside of the connections, primarily for aesthetic reasons.

The upper and lower brace elements include overlapping arcuate kneecap portions, namely an inner cap 22 at the upper end of the lower brace element, and an overlapping outer cap 24 at the lower end of the upper brace element. As can be seen in FIG. 5, when the knee is flexed, the upper brace remains with the lower thigh, so that that area remains protected. However, at the same time, because the caps overlap, there is no gap in protection of the knee.

A shin shield 26 is attached to the lower brace element by two rivets or screws 28, and is arranged to extend downwardly along the player's shin in conventional fashion, i.e. wrapping around at the least the front and sides of the player's leg. A flexible, padded thermoform liner 29 is positioned inside the shin shield, and is secured thereto by two rivets 30, one on either side of the pad.

Because the inner brace element and the shin shield are two separate components, the former can be made more anatomical than in prior art pads. A better fit on the shin and knee results.

The upper and lower brace elements and the shin shield are of relatively rigid construction, and may be of polyethylene, for example.

Stop means are provided to prevent rotation of the upper and lower brace elements beyond a selected maximum permissible extension angle, where said extension angle is defined as the angle of extension beyond 180 degrees, i.e. beyond alignment of the upper leg with the lower leg. The stop means resists or prevents hyperextension of the player's knee. The maximum permissible extension angle A is preferably set at about 10 degrees, but could be in the range of 0 to 20 degrees.

In the preferred embodiment, the stop means is the outer cap 24 coming into contact with the upper edge of the shin shield 26. These two components simply abut each other, such that further extension is prevented.

The somewhat rigid connection between the upper and lower brace elements provides improved lateral support, for protection against impacts from the side, by preventing or restricting lateral displacement of the knee.

Inside the lower brace element is a flexible, padded thermoform liner 31. On the inside of the liner is a section of hook and pile fastening material 32, e.g. Velcro (trademark), to which an insert 34, preferably of neoprene, may be secured at any desired position by virtue of corresponding fastening material 35. The neoprene insert is for the player to position in the hollow on the medial side of the tibia, for optimum fit and comfort.

Inside the upper end of the lower brace element, behind the inner cap 22, is a flexible, padded knee pad 36 of molded urethane. The lower portion of the knee pad fits generally within the cut-out upper area of the lower brace liner 31. On the front of the knee pad is another piece of Velcro (trademark) or similar fastening material, to position the knee pad on the inside of the inner cap, which bears similar fastening material (not shown).

inside the upper brace element 6, near the top thereof, is a flexible, padded liner 38. A raised area 40 helps to locate the liner, by fitting within an opening 42 in the upper brace element.

in order to allow for different knee widths, a sizing kit is preferably provided. The large washers 18, mentioned previously, have Velcro (trademark) or similar fastening material on the inner side thereof. Spacers 44 of varying thickness can be interposed between the washers and a patch of Velcro or the like on the outside of the knee pad 36, to provide the desired fit.

Another feature of the preferred embodiment, visible in FIG. 4, is that there is preferably a small angle B, e.g. about 0 to 10 degrees (6 degrees in the preferred embodiment), between the upper and lower brace elements, as seen from the back or front, to correspond to the typical angle between the femur and the tibia. The shin shield is then positioned at an angle C approximately 3 to 5 degrees from the lower brace.

These angles, the neoprene insert 34, and the sizing kit are all intended to provide greater anatomical correctness. This anatomical correctness, as well as providing a better fit and comfort, produces better bracing than would be the case with a loose-fitting pad.

It should be appreciated that the above description relates to the preferred embodiment by way of example only. Many variations on the invention will be obvious to those knowledgeable in the field, and such obvious variations are within the scope of the invention as described and claimed, whether or not expressly described.

It should also be appreciated that although the invention is especially designed for use in the sport of ice hockey, the same general construction could be readily adapted for use in shin pads in other sports where similar protection is required. The invention as defined in the appended claims is therefore not limited to ice hockey equipment, even though that is the primary intended application. The principle of the invention could be adapted to other sports if desired.

What is claimed as the invention is:

1. A shin pad for a sports player, comprising:

a rigid lower brace element including a lower shin portion and an arcuate inner knee cap portion securable around the player's leg below the knee;

a flexible lower brace element thermoform liner;

an upper brace element securable around the player's leg above the knee;

said upper brace element including an arcuate outer knee cap portion arranged such that there is no gap between said arcuate outer knee cap portion and said arcuate inner knee cap portion when the player's knee is flexed;

said lower and upper brace elements being pivotally connected to each other by pivotal connections on lateral and medial sides thereof, said pivotal connections being positionable on lateral and medial sides of the player's knee, in general alignment with the axis of the player's knee joint;

a cushioned shin shield liner; and a shin shield secured outside said rigid lower brace element and arranged to extend downwardly along the player's shin.

2. A shin pad as recited in claim 1, further comprising stop means comprising an uneven bottom edge of said upper brace element and a complementary uneven top edge of said shin shield, said bottom edge and said top edge being arranged to matingly abut one another to prevent rotation of said upper and lower brace elements beyond a preselected maximum permissible extension angle, thereby resisting hyperextension of the player's knee.

3. A shin pad as recited in claim 2, where said maximum permissible extension angle is in the range of 0 to 20 degrees.

4. A shin pad as recited in claim 2, where said maximum permissible extension angle is approximately 10 degrees.

5. A shin pad as claimed in claim 1, wherein said upper brace element and said lower brace element are positioned for rotation with one another at a small angle off the vertical; said angle corresponding to the angle at which a femur and tibia meet with one another; and said shin shield and said lower brace element are fixedly attached to one another at a small angle off the vertical which corresponds to the angle at which a patella meets said tibia.

* * * * *